US006910940B2

(12) United States Patent
O'Toole et al.

(10) Patent No.: US 6,910,940 B2
(45) Date of Patent: Jun. 28, 2005

(54) COLLECTIBLE AND METHOD OF MAKING THE SAME

(76) Inventors: Sean O'Toole, 1450 Brickell Bay Dr., Miami, FL (US) 33132-3642; William E. Drier, 1581 Brickel Ave., No. 607, Miami, FL (US) 33129

( * ) Notice: Subject to any disclaimer, the term of this patent is extended or adjusted under 35 U.S.C. 154(b) by 0 days.

(21) Appl. No.: 10/615,025

(22) Filed: Jul. 9, 2003

(65) Prior Publication Data

US 2004/0198162 A1 Oct. 7, 2004

Related U.S. Application Data

(60) Provisional application No. 60/434,430, filed on Dec. 19, 2002.

(51) Int. Cl.[7] ..... A63H 3/02; A63H 3/36

(52) U.S. Cl. ..... 446/369; 446/385

(58) Field of Search ..... 446/369, 385

(56) References Cited

U.S. PATENT DOCUMENTS

| | | | | |
|---|---|---|---|---|
| 1,545,083 A | * | 7/1925 | Marcy | 446/372 |
| 3,082,437 A | | 3/1963 | Upthagrove | |
| 3,678,616 A | * | 7/1972 | Goldfarb et al. | 446/371 |
| 3,977,121 A | * | 8/1976 | Goldfarb et al. | 446/369 |
| 4,224,712 A | | 9/1980 | Black et al. | |
| 4,842,565 A | * | 6/1989 | VonPhilp, Sr. | 446/321 |
| 4,889,512 A | * | 12/1989 | Burnett et al. | 446/72 |
| D364,004 S | | 11/1995 | Ederle | |
| 5,549,499 A | * | 8/1996 | Foskey et al. | 446/268 |
| 5,551,656 A | * | 9/1996 | De Lozada et al. | 248/176.1 |
| 5,664,258 A | | 9/1997 | Harris | |
| 5,762,531 A | * | 6/1998 | Witkin | 446/374 |
| D401,020 S | | 11/1998 | Barlow | |
| D409,036 S | | 5/1999 | Bear | |
| 6,108,855 A | | 8/2000 | DeLeon | |
| 6,193,577 B1 | * | 2/2001 | Kaplan | 446/72 |
| 6,217,406 B1 | * | 4/2001 | Ross | 446/370 |
| 6,383,053 B1 | * | 5/2002 | Segers | 446/386 |
| 6,612,896 B1 | * | 9/2003 | Choi | 446/370 |

* cited by examiner

*Primary Examiner*—Derris H. Banks
*Assistant Examiner*—Faye Francis
(74) *Attorney, Agent, or Firm*—Richard C. Litman

(57) ABSTRACT

A collectible with a core, a filler material, a fabric surface layer, and a fabric attachment. The core is situated inside the fabric surface layer and the fabric surface layer is stuffed with the filler material to form a body. The fabric attachment is attached to the body to form a body part shape. The collectible has an overall shape, which is substantially like an animal. Also, a method of making a collectible with a sizing step, a placing step, a stuffing step, and an attaching step. The collectible may be made from towels or the like. The core may be a bean bag.

9 Claims, 7 Drawing Sheets

COLLECTIBLE AND METHOD OF MAKING THE SAME

CROSS-REFERENCE TO RELATED APPLICATION

This application claims the benefit of U.S. Provisional Patent Application Ser. No. 60/434,430, filed Dec. 19, 2002.

BACKGROUND OF THE INVENTION

1. Field of the Invention

The present invention relates to a collectible and a method of making the same, and more particularly to a mass-produced, low-cost, keepsake collectible, which may be made substantially from towels or the like and may have a bean bag core.

2. Description of Related Art

Aboard a cruise ship, a guest may return to his or her room to find a small animal perched on their bed made from simple hand towels. Behind the scenes, a cabin steward or housekeeping staff member has folded a towel or towels by hand to create the likeness of the animal. For the passenger, these novelties are often a welcome and memorable part of the cruise experience, for adults as well as children.

Unfortunately, the conventional novelties are time-consuming to make and thus expensive, in terms of labor costs, for a cruise ship operator. Also, since the novelties are merely folded pieces of cloth, they are temporary in nature. Thus, the passenger or guest cannot realistically take the novelty home as a keepsake in order to remember the cruise. Even if they did, the novelty would not retain its shape over a long period of time. Further, the cruise ship operator does not wish to encourage the taking of towels, in the first place. Novelty towels and napkins may also be found in hotels or restaurants, aboard trains or planes, and in other hospitality and travel businesses.

There is a need for a mass-produced, low-cost novelty that can be taken home as a keepsake and which would be a replacement for the high-cost, temporary novelty of the prior art. A variety of U.S. patents disclose towels and toys; however, none are directed to a collectible and method of making a collectible which solves the aforementioned problems.

U.S. Pat. No. 3,082,437, issued Mar. 26, 1963 to S. Upthagrove, describes a novelty beach mat. U.S. Pat. No. 4,224,712, issued Sep. 30, 1980 to Black et al., describes a towel and method. U.S. Design Pat. No. 364,004, issued Nov. 7, 1995 to Ederle, describes a wash cloth for infants. U.S. Pat. No. 5,664,258, issued Sep. 9, 1997 to Harris, describes an animal/fowl caricature-like towel parka.

U.S. Design Pat. No. 401,020, issued Nov. 10, 1998 to Barlow, describes an oven pan pad. U.S. Design Pat. No. 409,036, issued May 4, 1999 to Bear, describes an ornamental child's pillow in the fanciful form of a turtle. U.S. Pat. No. 6,108,855, issued Aug. 29, 2000 to DeLeon, describes a hand towel. Japanese Patent No. 2001-340254, issued Dec. 11, 2001 to Hirotaka, describes a mascot shaped hand towel.

None of the above inventions and patents, taken either singly or in combination, is seen to describe the instant invention as claimed.

SUMMARY OF THE INVENTION

The present invention is directed to a collectible with a core, a filler material, a fabric surface layer, and a fabric attachment. The core, which may be a bean bag, is provided inside the fabric surface layer and the fabric surface layer is stuffed with the filler material to form a body. The fabric attachment is attached to the body to form a body part shape. The collectible has an overall shape, which is substantially like the animals created by the steward or housekeeping staff. The fabric surface layer and the fabric attachment may be towels or the like. The collectible may be a mass-produced, low-cost, keepsake collectible.

The present invention is also directed to a method of making a collectible. The method includes a sizing step, a placing step, a stuffing step, and an attaching step. In the sizing step, a core, a fabric surface layer, a filler material, and a fabric attachment are sized such that the collectible is adapted to have an overall shape, which is substantially like an animal. In the placing step, the core is placed inside the fabric surface layer. In the stuffing step, the fabric surface layer is stuffed with the filler material to form a body. In the attaching step, the fabric attachment is attached to the body to form a body part shape. The method may be adapted to mass-produce a low-cost, keepsake collectible.

Accordingly, it is a principal object of the invention to provide a collectible with a core, a filler material, a fabric surface layer, and a fabric attachment.

It is another object of the invention to provide a method of making a collectible including a sizing step, a placing step, a stuffing step, and an attaching step.

It is a further object of the invention to provide a collectible with a core, a filler material, a fabric surface layer, and a fabric attachment, where the fabric surface layer and the fabric attachment are made from towels.

Still another object of the invention is to provide a collectible with a beanbag core, a filler material, a fabric surface layer, and a fabric attachment.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a collectible 10 and a method 100 of making the same. The present invention is particularly directed to a mass-produced, low-cost, keepsake collectible which is a substitute for the hand-made, high-cost, temporary novelties, noted above. The collectible 10 may be made substantially from towels or the like.

Figure 1:
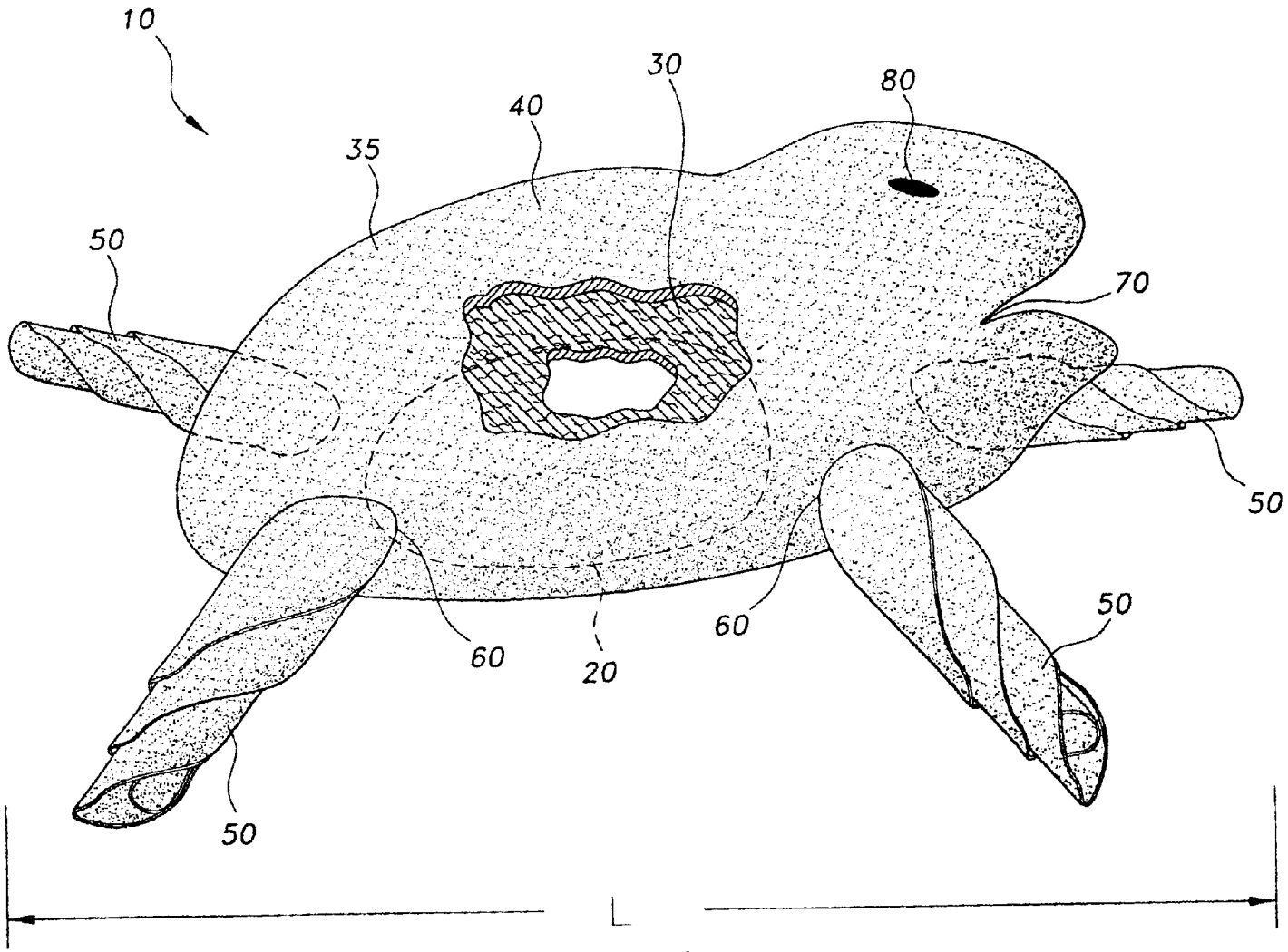
FIG. 1 is an environmental, perspective side view of a collectible according to the present invention with a cutaway view of the core, the filler material, and the fabric surface layer.

As shown in FIG. 1, the collectible 10 comprises a core 20, a filler material 30, a fabric surface layer 40, and a fabric attachment 50. The collectible 10 has an overall shape which is substantially that of an animal. The overall shape refers to the fact that the collectible 10 is assembled in a manner such that is not temporary and is intended to keep its shape.

Figure 2:
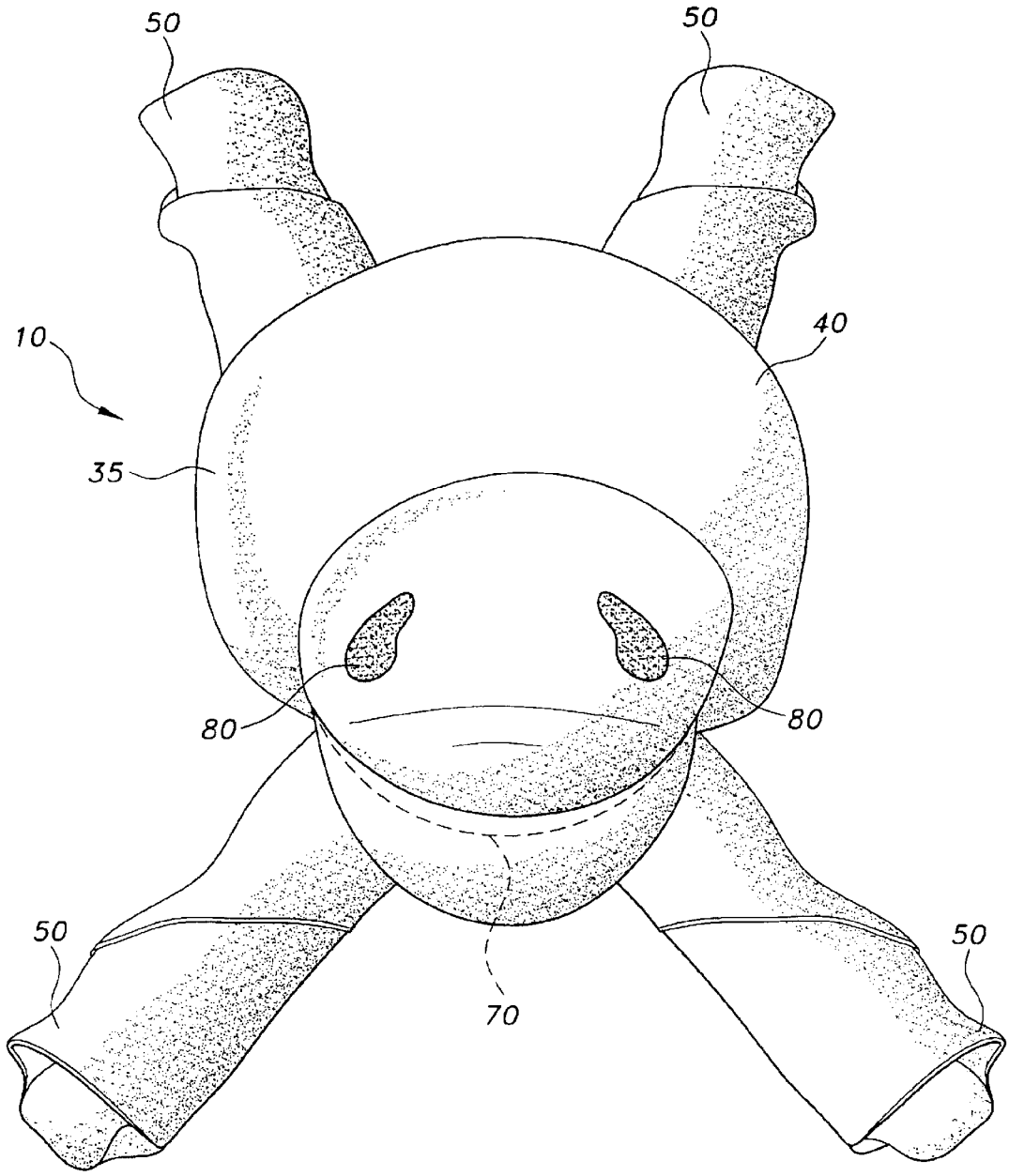
FIG. 2 is an environmental, perspective view of a collectible in the fanciful form of a frog.
Figure 4:
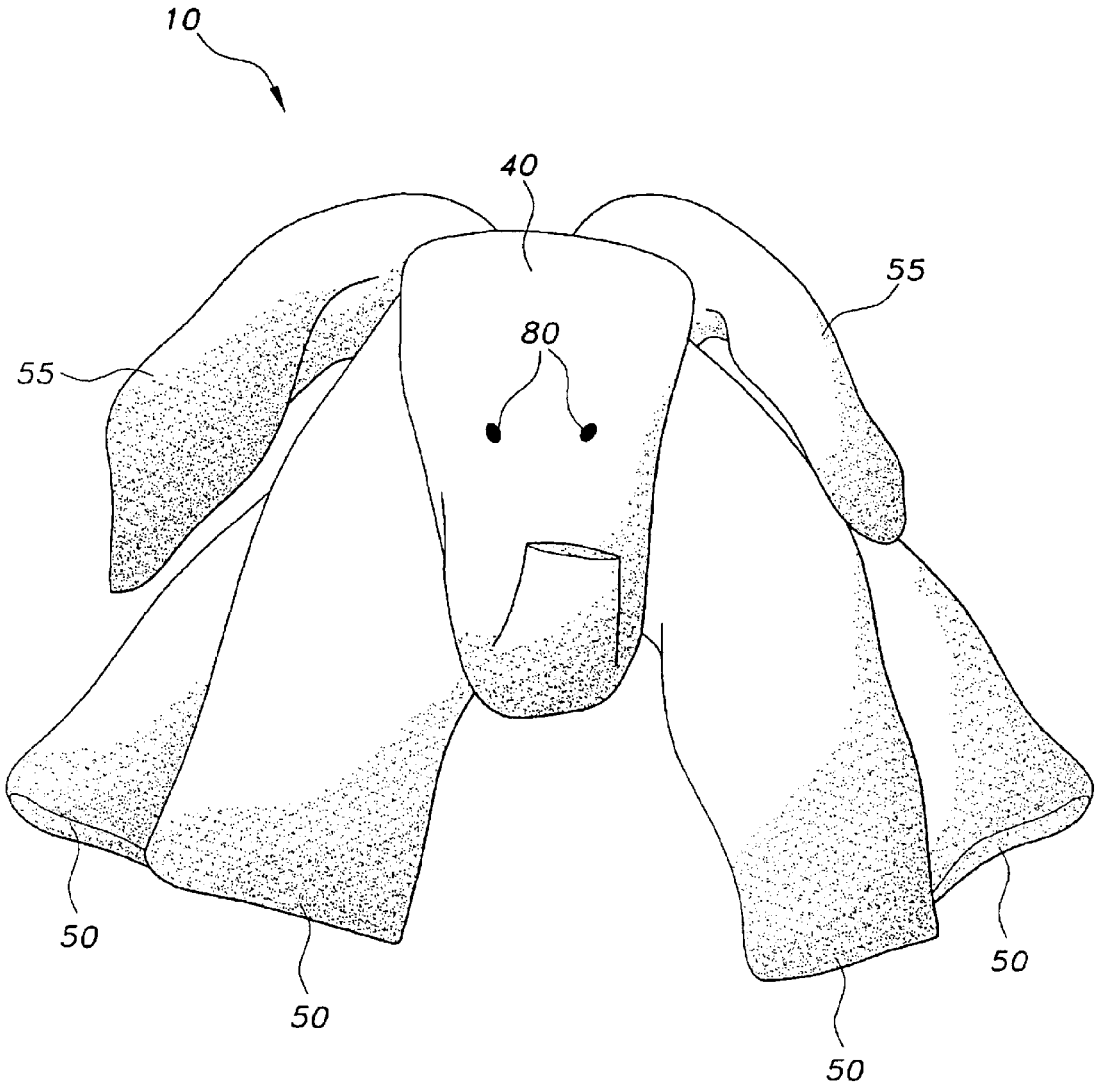
FIG. 4 is an environmental, perspective view of a collectible in the fanciful form of an elephant.
Figure 5:
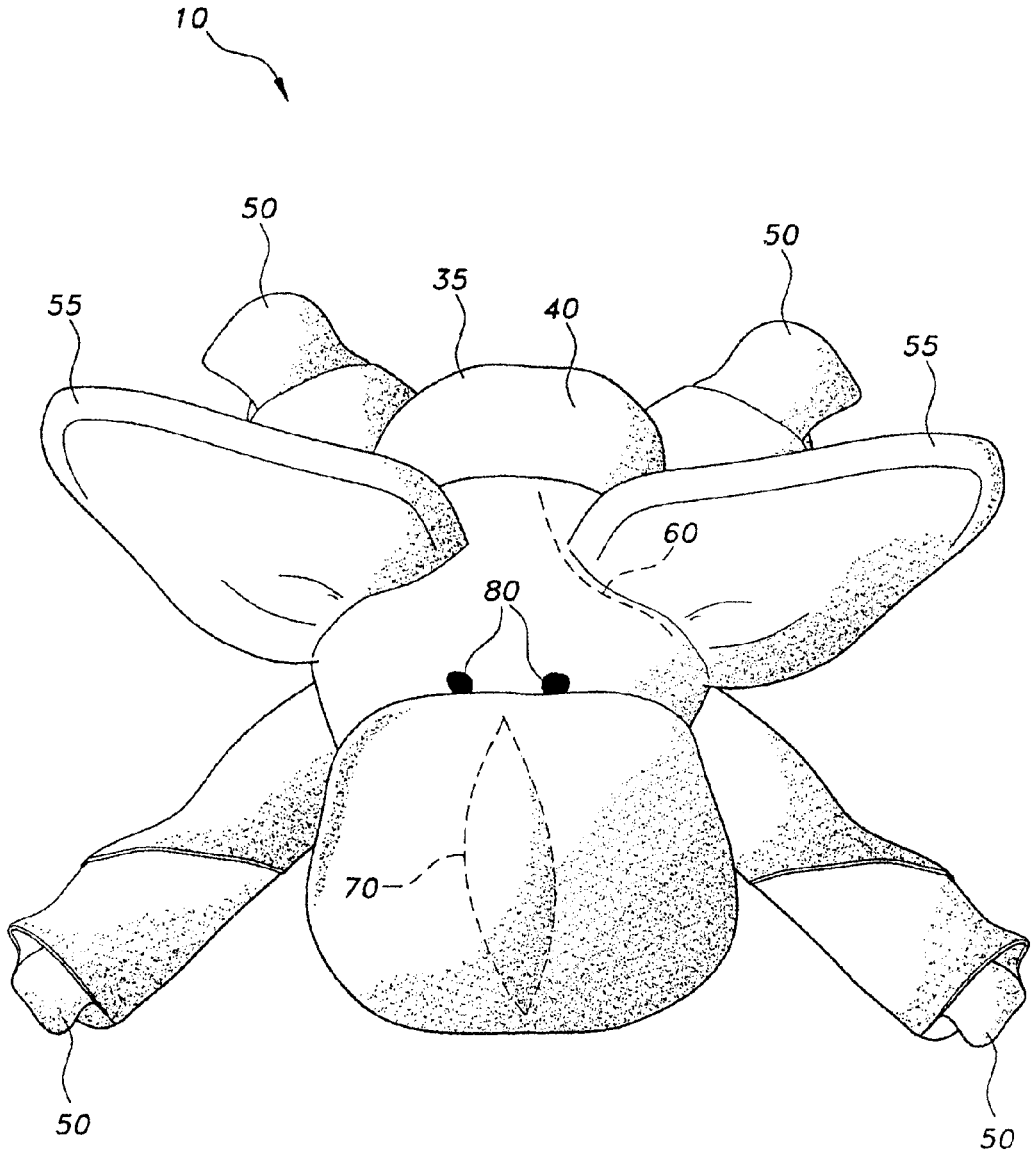
FIG. 5 is an environmental, perspective view of a collectible in the fanciful form of a hippopotamus.
Figure 6:
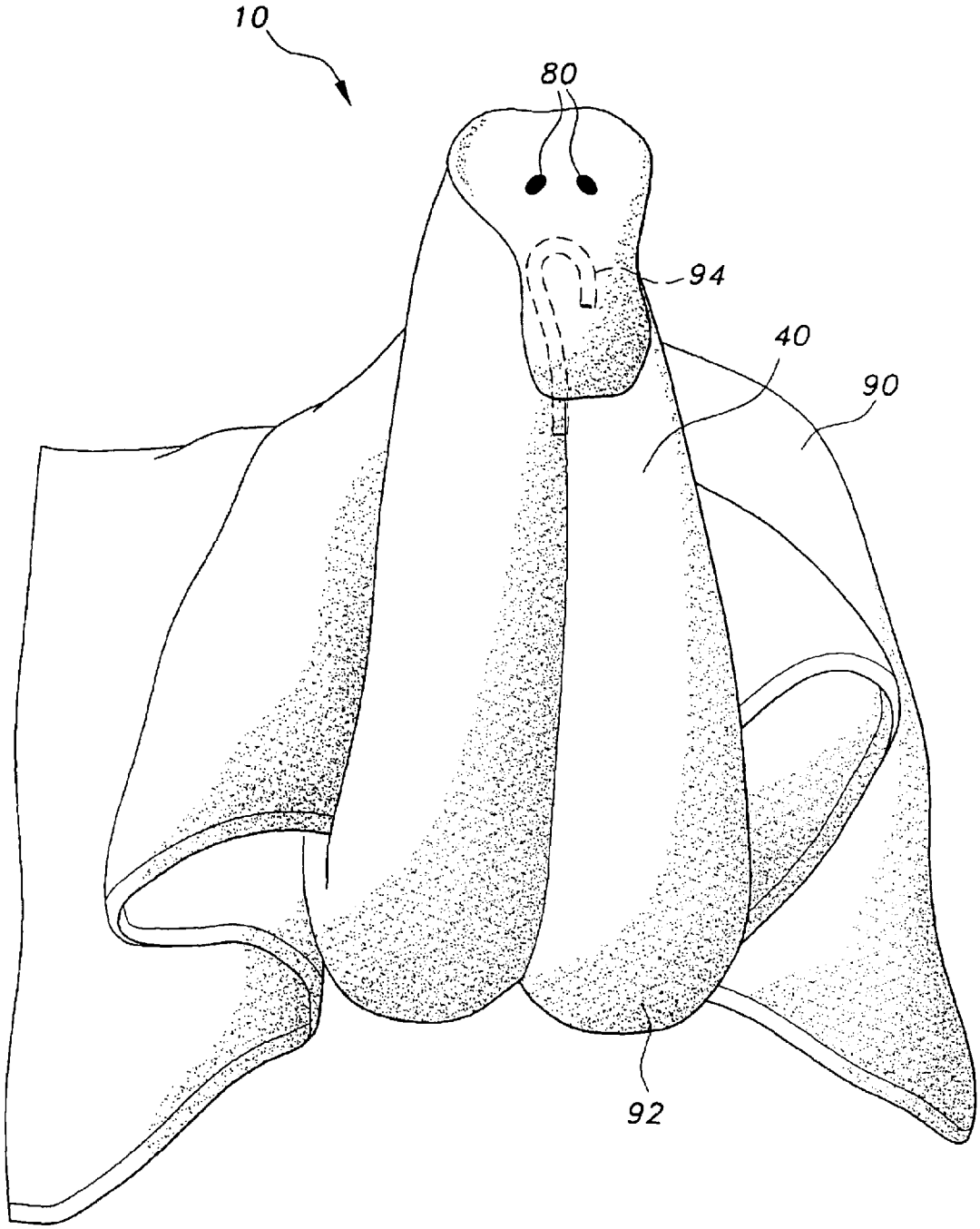
FIG. 6 is an environmental, perspective view of a collectible in the fanciful form of a swan.

As illustrated herein, the overall shape of the collectible 10 may approximate that of a frog (FIG. 2), a pig (FIG. 3), an elephant (FIG. 4), a hippopotamus (FIG. 5), or a swan (FIG. 6). However, the overall shape of the collectible 10 may be substantially that of any animal (i.e. dog, monkey, tiger, etc.). The overall shape of the collectible 10 desirably contains sufficient characteristics to form an attractive approximation of the animal being depicted.

The core 20 is provided inside the fabric surface layer 40 and the fabric surface layer 40 is stuffed with the filler material 30 to form a body 35. The core 20 may be any suitable core material which provides the collectible 10 with sufficient weight which is desirable for collectibles, particularly collectibles which are meant to be handled and may be used as a toy. The core 20 may, desirably, be a beanbag or the like. Also, the core 20 may be positioned inside the collectible 10 in a manner such that the collectible 10 is adapted to sit upright. The position of the core 20 in the collectible 10 may be adapted to suit the particular character being constructed.

The filler material 30 may be any suitable material for stuffing the collectible 10. The filler material 30 may be cotton, polyester, beans, sawdust, feathers, and the like. A sponge-like material may also be used as filler, which will allow the collectible to be used in water as, for example, a bath sponge.

The fabric surface layer 40 and the fabric attachment 50 may be made from any suitable material for holding the filler material 30 and maintaining the overall shape of the collectible 10. The fabric surface layer 40 and the fabric attachment 50 may desirably be made from cloth and may be in the form of one or more napkins or towels. Preferably, cotton towels, and even more preferably, 100% cotton terry cloth towels may be used for the fabric surface layer 40 and the fabric attachment 50 of the collectible 10. Also, the fabric surface layer 40 may be made from several pieces, which are stitched together to form the overall shape of the collectible 10.

When the collectible 10 of the present invention is made with towels, the collectible 10 evokes the look and feel of the hand-made, high-cost, temporary novelty, noted above. Although, it is preferable that the towels be white, any color may be used, for example, a green towel for a frog collectible 10.

The fabric attachment 50 is attached to the body 35 to form a body part shape. The fabric attachment 50 may be attached using any suitable means for the attachment of fabric, such as a stitched seam 60, which may be visible or hidden. The body part shape may have the approximate form of, for example, an arm or leg shape 50 (FIGS. 1–5), an ear shape 55 (FIGS. 3–5), a wing shape 90 (FIG. 6), or a neck and head shape 92 (FIG. 6) of an animal. Other body part shapes may be made, as appropriate.

Figure 3:
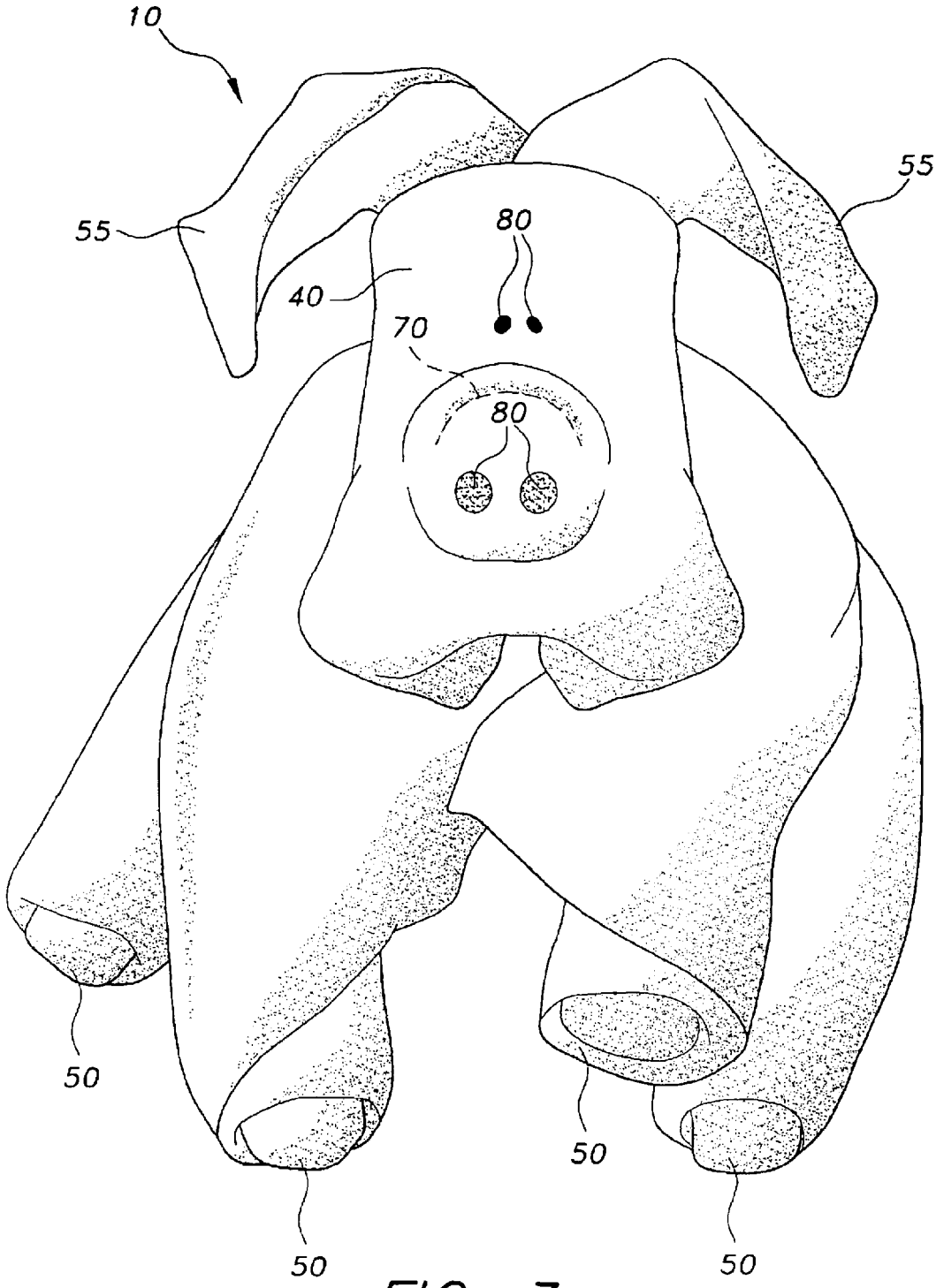
FIG. 3 is an environmental, perspective view of a collectible in the fanciful form of a pig.

The collectible 10 may further comprise a sewn-in animal feature 70. The sewn-in animal feature 70 may be, for example, an approximation of a mouth shape (FIG. 1) or a snout shape (FIG. 3). Other animal features may be made, as appropriate. Any color or type of thread may be used for the sewn-in animal feature 70. It may be desirable to match the color of the thread to the color of the towel or to use clear thread, such as nylon.

The collectible 10 may further comprise an embroidered animal feature 80. The embroidered animal features 80 may be, for example, an eye shape (FIGS. 1–6) or a nostril shape (FIG. 3). Other animal features may be made, as appropriate. Any color or type of thread may be used for the embroidering.

The collectible 10 may further comprise a plastic support piece 94. For example, in forming the swan (FIG. 6), the plastic support piece 94 is provided inside the collectible 10 to support the neck shape 92 of the collectible 10.

The collectible 10 may have an overall length L, which is less than 12". Preferably, the collectible 10 has an overall length L of between 6" and 12". Even more preferably, the overall length L of the collectible 10 is about 9". The present inventor has found that these overall lengths are desirable in the marketplace, particularly in the collectibles marketplace.

Figure 7:
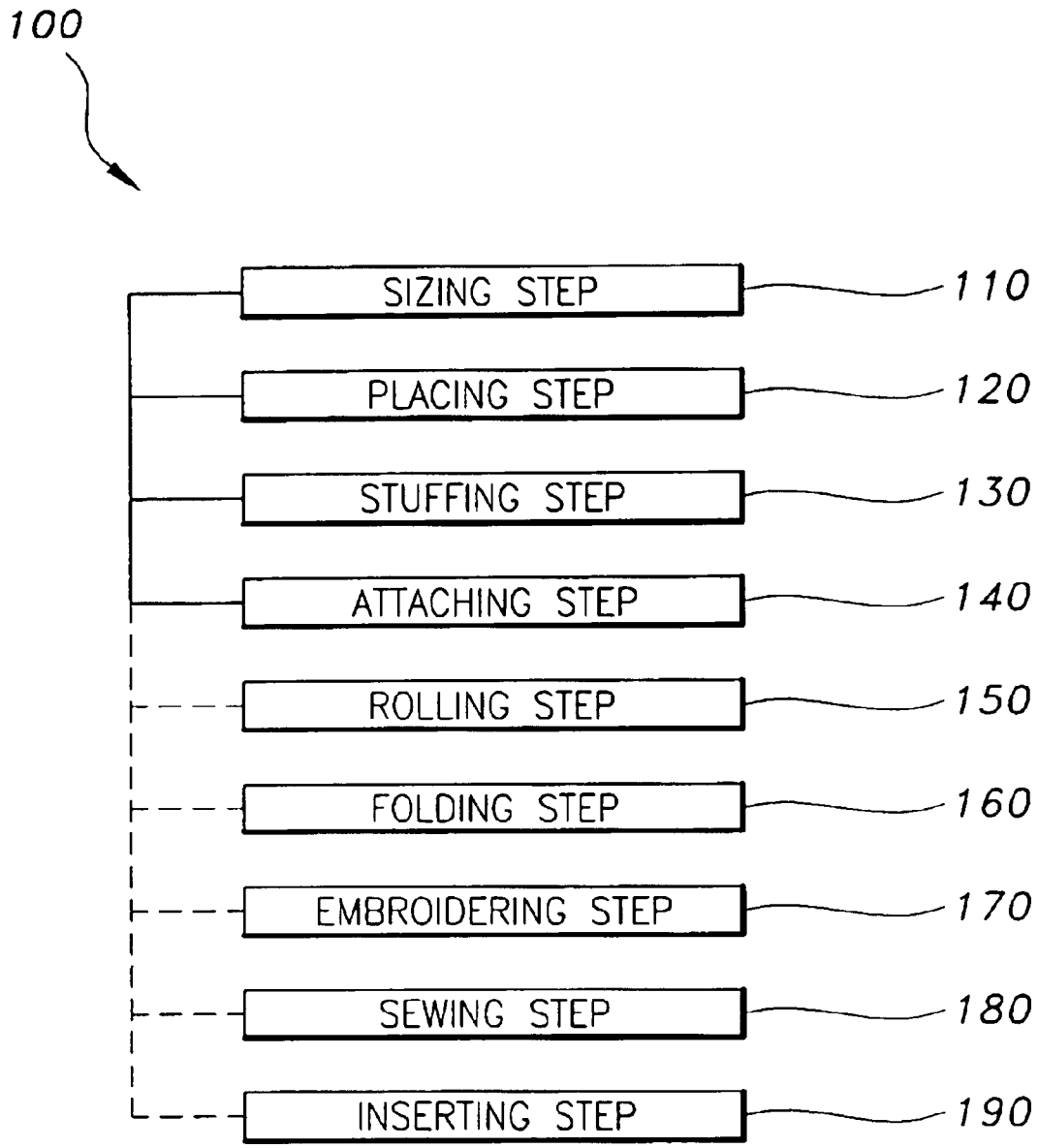
FIG. 7 is a diagram of a method of making a collectible.

As noted above, the present invention is also directed to a method 100 of making a collectible 10. The method 100 may be a mass production method. As shown in FIG. 7, the method 100 comprises a sizing step 110 where the core 20, the fabric surface layer 40, the filler material 30, and the fabric attachment 50 are sized such that the collectible 10 is adapted to have an overall shape which is substantially that of an animal, as noted above. The sizing step 110 may be performed by hand or machine.

The method 100 also comprises a placing step 120 wherein the core 20 is placed inside the fabric surface layer 40, a stuffing step 130 wherein the fabric surface layer 40 is stuffed with the filler material 30 to form a body 35, and an attaching step 140 wherein the fabric attachment 50 is attached to the body 35 to form the body part shape 50, 55, 90, 92, all of which may be performed by hand or with suitable equipment for placing, stuffing, and attaching.

Although the steps of the method 100 are presented and shown in a particular order, the steps may be performed in any order that is suitable for making the collectible 10 of the present invention.

The method 100 may further comprise a rolling step 150 wherein the fabric attachment 50 is formed by rolling a towel. For example, the arm or leg shape 50 (FIGS. 1–5) or the neck and head shape 92 is formed using a rolling technique by hand or machine.

The method 100 may further comprise a folding step 160 wherein the fabric attachment 50 is formed by folding a towel. For example, the ear 55 (FIGS. 3–5) of the collectible 10 is formed using a folding technique by hand or machine.

The method 100 may further comprise an embroidering step 170 wherein the embroidered animal feature 80 is embroidered by hand or machine into the fabric surface layer 40.

The method 100 may further comprise a sewing step 180 wherein the sewn-in animal feature 70 is sewn by hand or machine into the fabric surface layer 40.

The method 100 may further comprise an inserting step 190 wherein a plastic support piece 94 is inserted by hand or machine inside the collectible 10.

Due to the inexpensive materials and manufacturing methods of the present invention, the collectible 10 of the present invention may be adapted for mass production according to the method 100 of the present invention. The mass production may be by hand or machine. The present inventor has found that the collectible 10 made according to the method 100 of the present invention may be sold for a significant profit per unit.

It is to be understood that the present invention is not limited to the sole embodiments described above, but encompasses any and all embodiments within the scope of the following claims.

We claim:

1. A collectible having an aesthetically appealing form and texture in the form of an animal, comprising:

an outer fabric surface layer defining an enclosed volume;

a core disposed within a portion of the enclosed volume of said outer fabric surface, wherein said core is a bean bag;

said core filling a portion of the enclosed volume of said outer fabric surface; and a plurality of attachments formed of rolled fabric portions for simulating an appendage of an animal;

wherein said outer fabric surface and said rolled fabric portions are formed of a soft fabric material, and said core defines an internal volume within the enclosed volume of said outer fabric outer surface.

2. The collectible according to claim 1, further comprising an anatomical animal feature on said outer fabric surface; wherein said anatomical animal feature in formed from the group consisting essentially of an embroidery or sewing.

3. The collectible according to claim 1, wherein said soft fabric material is terrycloth towel.

4. The collectible according to claim 1, further comprising a stuffing enclosed within said outer fabric surface layer, whereby said stuffing and said core fill the enclosed volume.

5. The collectible according to claim 1, further comprising a plastic support piece.

6. The collectible according to claim 1, further comprising a weight disposed within a portion of the enclosed volume of said outer fabric surface, whereby said weight provides stabilization of the collectible on a supporting surface.

7. A collectible having an aesthetically appealing animal form and texture, comprising:

an outer fabric surface layer defining an enclosed volume;

a core disposed within a portion of the enclosed volume of said outer fabric surface, said core is a bean bag;

a filler material disposed within said outer fabric surface;

said core and said filler material completely filling the enclosed volume of said outer fabric surface; and a plurality of attachments formed of rolled fabric portions for simulating an appendage of an animal;

wherein said outer fabric surface and said rolled fabric portions are formed of a soft fabric terrycloth towel material, said filler material is resilient for maintaining a predetermined shape of said outer fabric surface, said core defines an internal volume with the enclosed volume of said outer fabric outer surface.

8. The collectible according to claim 7, further comprising an anatomical animal feature on said outer fabric surface; wherein said anatomical animal feature in formed from the group consisting essentially of an embroidery or sewing.

9. The collectible according to claim 7, further comprising a plastic support piece.

* * * * *